US005767459A

United States Patent [19]

Sell

[11] Patent Number: 5,767,459

[45] Date of Patent: Jun. 16, 1998

[54] MUFFLER FOR PNEUMATIC DEVICES

[75] Inventor: Leslie J. Sell, North Bend, Wash.

[73] Assignee: Ingersoll-Rand Company, Woodcliff Lake, N.J.

[21] Appl. No.: 959,745

[22] Filed: Oct. 28, 1997

Related U.S. Application Data

[63] Continuation of Ser. No. 746,957, Nov. 18, 1996, abandoned.

[51] Int. Cl.[6] ..... F01N 1/24

[52] U.S. Cl. ..... 181/258; 181/230

[58] Field of Search ..... 181/230, 229, 181/243, 252, 256, 258, 282

[56] References Cited

U.S. PATENT DOCUMENTS

| | | | |
|---|---|---|---|
| 3,842,932 | 10/1974 | Gibel | 181/258 |
| 4,082,160 | 4/1978 | Schilling et al. | 181/258 |
| 4,134,472 | 1/1979 | Trainor | 181/230 |

*Primary Examiner*—Khanh Dang
*Attorney, Agent, or Firm*—Walter C. Vliet; Leon Nigohosian, Jr.

[57] ABSTRACT

A muffler utilizing a stackable porous disk sandwiched between a threaded mounting plate and an end cap and utilizing tie rods to assemble the stack is provided.

5 Claims, 1 Drawing Sheet

MUFFLER FOR PNEUMATIC DEVICES

This application is a continuation of application Ser. No. 08/746,957, filed Nov. 18, 1996, now abandoned.

BACKGROUND OF THE INVENTION

This invention relates generally to noise reduction devices and more particularly to a stackable porous section muffler. The use of mufflers to reduce exhaust noise from pneumatic devices is well known. In the past, such muffling devices have been generally of a unitized design suitable for a particular application in size and shape depending on the application, exhaust qualities such as pressure, and volume of exhaust.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a muffler for pneumatic devices including an end mounting exhaust inlet cap; a distal end compression cap; a plurality of stacked hollow porous sections forming an interior chamber; and means for positioning and compressing the porous sections between the inlet cap and the compression cap.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
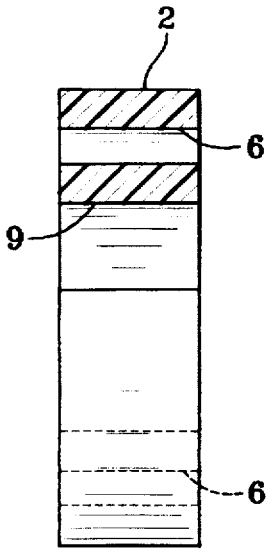
FIG. 1 is a partially sectioned side view of a muffler segment according to the present invention.
Figure 2:
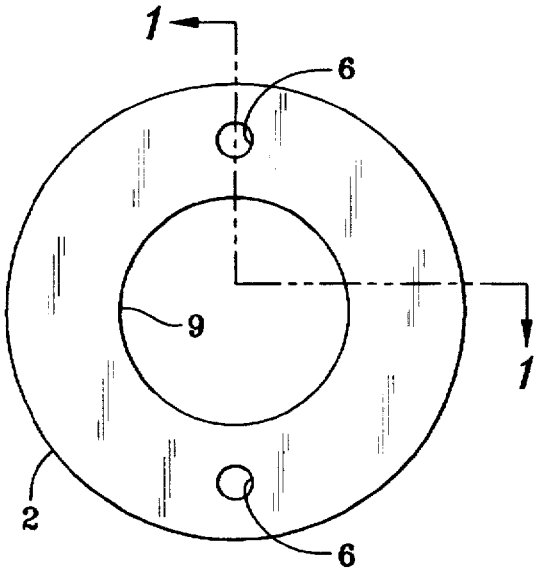
FIG. 2 is an end view of a muffler segment according to the present invention.
Figure 3:
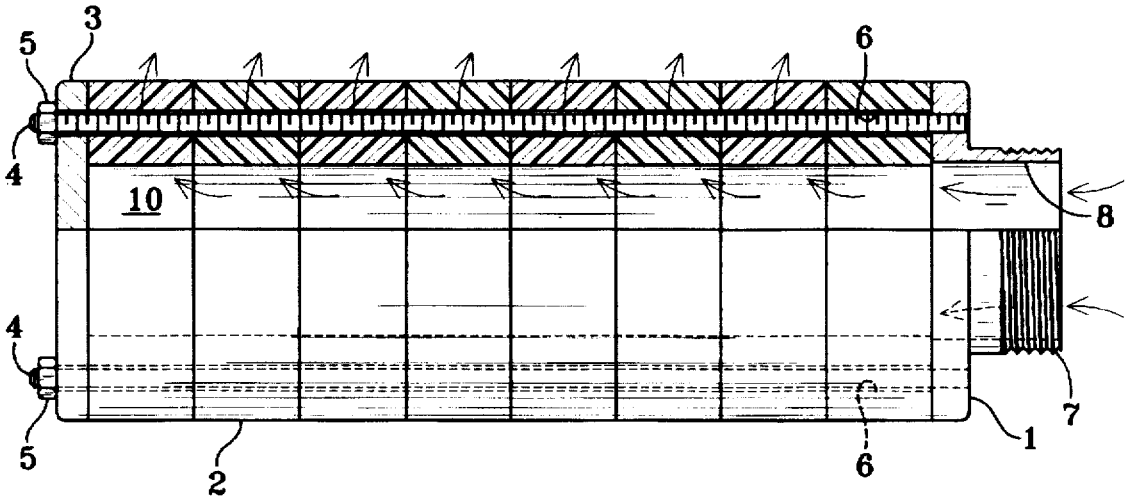
FIG. 3 is a partially sectioned side view of an assembled muffler utilizing the muffler sections according to the present invention.

A muffler and method of assembly for a muffler from pneumatic devices of the type used for silencing the exhaust of pneumatic devices, such as air motors, is generally shown in FIGS. 1–3. This type of muffler which filters exhaust air from the device through a sound absorbing material may be manufactured economically in small quantities using standard commercially available porous sheet material. A preferred material that has excellent sound absorbing qualities is porous plastic. The method of manufacturing assembly allows a muffler to be constructed in any combination of inside and outside shape and size without the need for special tooling. To achieve this flexibility a series of porous plastic sections of appropriate thickness such as shown in FIGS. 1 and 2 are stacked together to form a muffler section of the required length. The number of sections can be varied to suit the performance requirements. A further advantage of this method is that it is also adaptable to high volume production since the porous plastic sections can be economically molded.

Referring to the figures, FIG. 3 shows a partial cross section of a muffler according to the present invention. To form the muffler, identical stackable porous sections 2 are sandwiched between a threaded mounting plate 1 and an end cap 3. Tie rods 4, threaded into the mounting plate 1, pass through holes 6 in each stackable porous section and through end cap 3. The fasteners, such as for example nuts 5, clamp the sections firmly together. The mounting plate 1 may be provided with an external threaded neck 7 for attachment to the exhaust port of a pneumatic tool. Air exhausting the pneumatic device enters the muffler through open inlet 8 in the mounting plate and passes into the interior volume 10 of the muffler formed by the hollow center 9 of each of the porous sections.

The exhaust air compressed in the interior volume passes through the porous sections 2 from the inside to the outside with muffled noise. The degree of porosity and the size of the muffler can be varied to accommodate different pressure and volume requirements necessary to achieve adequate sound muffling. The end plate or cap 3 prevents escape of the exhaust through the end of the muffler and further provides a means for compressing the stacked porous sections between the end plate 3 and the mounting plate 1. Although the stackable porous sections are shown in the shape of hollow cylinders or donuts 2 it should be understood that square or other shaped segments may also be utilized in a similar stacking arrangement.

The stackable sections are manufactured from a rigid porous material such as plastic. The size of the muffler may be varied readily by increasing the length of the muffler by adding porous sections or utilizing larger diameter sections. It should be understood by one skilled in the art that standard stackable sections can be utilized to produce a wide range of muffler size in both length and dimension with significant economy in manufacture for the wide range of mufflers required by various pneumatic device applications. A similar muffler construction may find use in other noise abatement applications, such as for example combustion engine exhaust noise using higher temperature porous materials.

Having disclosed my invention in terms of a preferred embodiment, I do not wish to be limited in the scope of my invention except as claimed.

What is claimed is:

1. A stackable section muffler for a pneumatic device comprising:

an end mounting exhaust inlet cap;

a distal end compression cap;

a plurality of non-deformable stacked hollow porous sections forming an interior distribution chamber and exterior porous shell; and means for positioning and compressing said porous sections between said inlet cap and said compression cap, wherein said non-deformable stacked hollow porous sections resist compression applied by said means for positioning and compressing.

2. A muffler for a pneumatic device according to claim 1 wherein:

said end mounting cap is further provided with attachment means for assembly to a pneumatic tool.

3. A muffler for a pneumatic device according to claim 1 wherein:

said hollow porous sections are formed from a porous plastic material.

4. A muffler for a pneumatic device according to claim 1 wherein:

said means for positioning and compressing said porous sections comprise a threaded end rod and said porous sections are provided with a bore for receiving said rod.

5. A muffler for a pneumatic device according to claim 1 wherein:

said hollow porous sections are cylindrical.

* * * * *